United States Patent [19]

Reibel

[11] 4,365,556

[45] Dec. 28, 1982

[54] METHOD AND SYSTEM FOR PREVENTING BASE SEPARATION OF CAST EXPLOSIVES IN PROJECTILES

[75] Inventor: Paul F. Reibel, Sparta, N.J.

[73] Assignee: The United States of America as represented by the Secretary of the Army, Washington, D.C.

[21] Appl. No.: 194,314

[22] Filed: Oct. 6, 1980

[51] Int. Cl.[3] ..... F42B 1/02

[52] U.S. Cl. ..... 102/307; 102/309; 102/321; 102/331; 86/20 A

[58] Field of Search ..... 102/306–309, 102/321, 331, 479, 439; 86/20 A, 20 B

[56] References Cited

U.S. PATENT DOCUMENTS

| | | | |
|---|---|---|---|
| 1,039,204 | 9/1912 | Sokolowski | 86/20 B |
| 2,345,887 | 4/1944 | Rothrock | 86/20 A |
| 3,688,702 | 9/1972 | Prior et al. | 102/308 X |
| 4,259,906 | 4/1981 | Krauch, Jr. et al. | 102/306 X |

*Primary Examiner*—Peter A. Nelson

*Attorney, Agent, or Firm*—Nathan Edelberg; Robert P. Gibson; A. Victor Erkkila

[57] ABSTRACT

Base separation of cast explosives in projectiles is prevented by means of a resilient device, such as a spring washer, positioned between the bottom of the fuzewell cavity in the cast explosive and the bottom of the fuzewell liner threadedly secured to the projectile. By tightening the liner, the spring washer is compressed, causing it to apply a force upward on the liner and downward on the cast explosive toward the base of the projectile, thereby allowing the cast explosive to move in response to thermal changes while maintaining it in contact with the projectile base at all times.

13 Claims, 3 Drawing Figures

METHOD AND SYSTEM FOR PREVENTING BASE SEPARATION OF CAST EXPLOSIVES IN PROJECTILES

GOVERNMENTAL INTEREST

The invention described herein may be manufactured, used and licensed by the Government for Government purposes without the payment to me of any royalties thereon.

BACKGROUND OF THE INVENTION

Artillery projectiles are conventionally loaded with cast explosives by pouring the liquid explosive composition into the projectile shell through a funnel inserted into the threaded opening in the nose of the shell, and allowing the explosive composition to cool or cure to a solid cast. After removal of the funnel, a cavity is drilled in the cast and a threaded, metal fuzewell liner for containing a fuze or supplementary charge for detonating the explosive is inserted into the cavity, and then threadedly secured to the shell at said opening.

Tests have shown that the probability of dangerous premature explosions in the gun barrel, i.e. explosive initiation by setback pressures and shock in high explosive loaded artillery projectiles, is substantially increased by the presence of separation between the base of the shell and the explosive cast. Much effort has been directed to minimizing such base separation during loading operations due to contraction of the cast on cooling and solidification. At present, most projectiles are post-heated in an attempt to minimize such base separation. During the post heating operation, the explosive charge, e.g. TNT and Composition B, is heated and then cooled, whereby the volume of the cast in the projectile can be increased by a small, limited amount. This expensive procedure is repeated up to three recycle operations in an attempt to meet the maximum allowable base separation, which if not achieved requires that the projectile must be suitably reworked, which is costly, since it is unfit for field use. While this procedure does not eliminate base separation entirely, it has enabled most lots of projectiles to meet specification requirements.

SUMMARY OF THE INVENTION

Accordingly, it is an object of the present invention to provide a method for preventing or greatly minimizing base separation of high explosive casts in artillery projectiles. A further object of the present invention is to provide a system for preventing or greatly minimizing base separation of high explosive casts in artillery projectiles. Other objects will become apparent from the description of the invention.

It has found that the foregoing objects can be attained by employing a relatively strong threaded fuze well liner and inserting a resilient means or compensator, such as a wave spring washer or a washer comprising an organic elastomeric material, between the bottom of said liner and the bottom of said cavity. By tightening the liner, the spring washer is compressed, causing the compressed washer to apply a force upward on the base of the liner and downward on the cast explosive toward the base of the projectile shell. In this manner the resilient means allows the explosive cast to move in response to thermal changes but essentially maintains the explosive cast in contact with the base of the projectile shell.

DETAILED DESCRIPTION OF THE INVENTION

Figure 1:
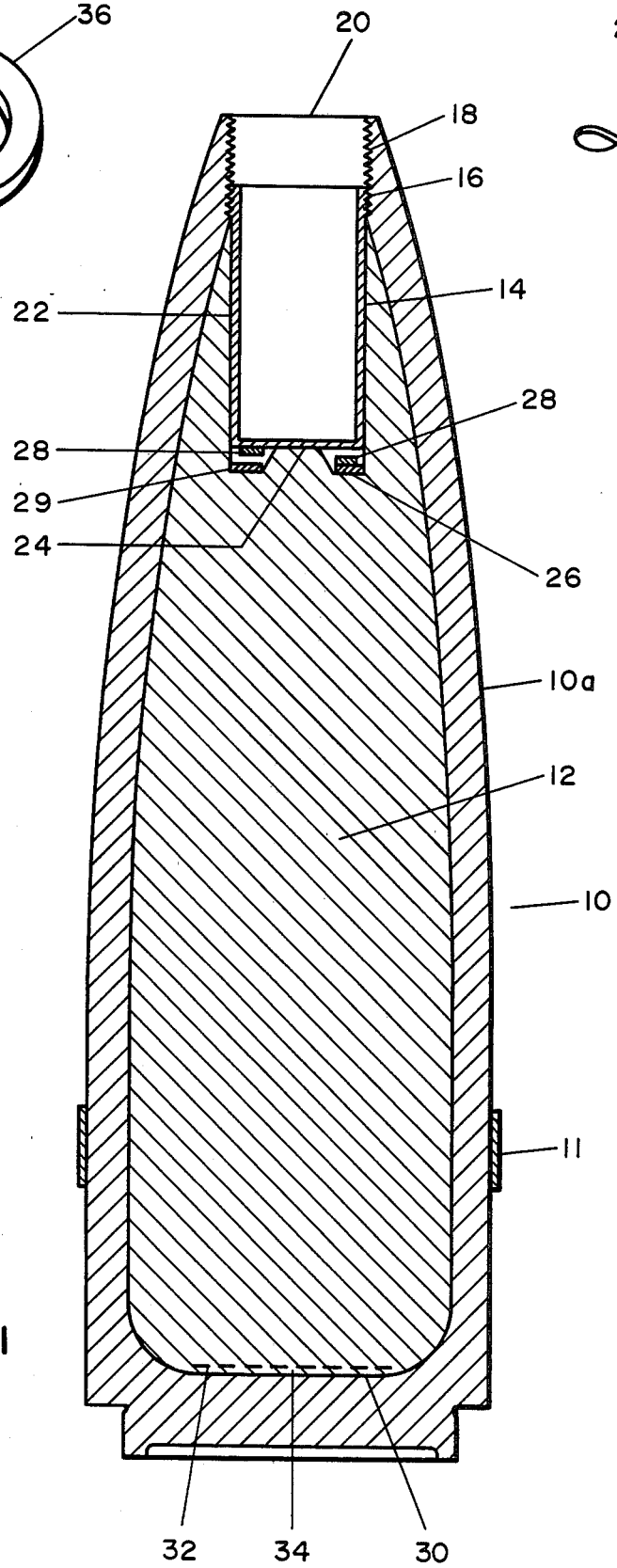
FIG. 1 illustrates a longitudinal cross-sectional view of a preferred embodiment of a projectile system of the present invention.

FIG. 1 shows an artillery projectile 10 including a steel shell or casing 10*a* provided with a conventional rotating band 11 for engaging the gun barrel rifling. The hollow casing is filled with a cast 12 of high explosive such as TNT (Trinitrotoluene), Composition B, etc. A cylindrical aluminum fuze well liner 14, containing external threads 16 which mate with internal threads 18 of the central opening 20 of the forward end of the projectile shell, is positioned in a corresponding cylindrical cavity 22 in the cast explosive 12. The bottom 24 of the cavity is provided with a circumferential annular channel 26, in which an annular washer of resilient material, such as a wave spring washer 28, is placed on a flat ring washer 29 seated on the cast explosive at the bottom of said cavity.

The projectile assembly is accomplished as follows:

A castable high explosive composition, such as molten TNT or other castable explosive, is poured into the projectile shell 10 through a funnel (not shown), inserted into the open end 20 of the shell, until the shell is completely filled. Preferably, a thread protector and seal device, as described in U.S. Pat. No. 4,094,224, is inserted into the internally threaded open end of the shell prior to the insertion of the funnel to prevent explosive material from flowing into said threaded area, wherein such explosive contamination could cause premature explosion when the fuze assembly is inserted therein. The explosive composition is allowed to cool to a solid cast, after which the funnel with breaking of the funnel cast and thread protector are removed. The cavity 22 is then drilled out by means of a bit, which preferably forms a peripheral annular channel or groove 26 in the bottom 24 of the cavity, after which the cavity and threads are cleaned of explosive particles by vacuuming. A steel wave spring washer 28, having a wave height greater than the depth of channel 26 so that it projects above the plateau 24 in the center of the cavity bottom, is placed in the annular groove 26. If necessary, a flat metal washer 29, is placed on the annual groove 26 prior to placement of the wave spring washer. The spring washer and flat washer are preferably coated with nylon. A threaded aluminum fuzewell liner 14, which is stronger than conventional fuzewell liners in order to have the necessary strength to compress the spring washer, is then inserted into the cavity and screwed down to compress the spring washer sufficiently. The plateau 24 functions as an automatic stop for the liner and prevents overcompression (i.e. beyond the elastic limit) of the spring washer and hence loss of its resilience when the liner is tightened or when the cast subsequently expands on storage of the projectile at elevated temperatures. In the resulting compressed state the spring washer exerts an upward force on the base of the liner and a downward force on the explosive cast toward the base of the projectile shell. The threaded liner is locked in place, as by swaging, to prevent loosening during handling. A suitable sealer, such as Loctite®, can be placed in the threads 18 of the open end of the shell to prevent the explosive from escape through the thread area if the explosive is overheated.

As previously noted, in the absence of the spring washer, when the loaded projectile is exposed to low temperatures, e.g. −40° F., the explosive cast contracts with the result that the surface of the cast initially in contact with the base 30 of the shell can separate therefrom, as indicated by phantom line 32 and produces a gap 34, which is usually referred to as base separation. In operation, the resilient washer employed according to the present invention permits the explosive cast to contract and expand due to thermal changes, but constantly maintains a downward force on the cast sufficient to keep the cast in contact with the base of the shell or greatly minimize separation of the cast from the base of the shell.

Two or more metal wave spring washers may be stacked, as required, to adjust the force needed to prevent or reduce base separation, depending on the size and configuration of the explosive cast and the thermal expansion/contraction characteristics thereof. If required, a flat metal washer can be advantageously employed between the wave spring washer and the explosive cast to distribute the compressive load over a greater surface. The metal washers are preferably coated with an organic material compatible with the explosive, such as nylon and polyurethane, to avoid potentially dangerous metal-to-metal contact. The force in pounds per square inch applied to the cast explosive by the resilient washer should not exceed the compressive strength of the cast, ie. the ability of the explosive cast to support a load without deformation (creep) throughout the practical temperature range at which the projectile is stored.

Figure 2:
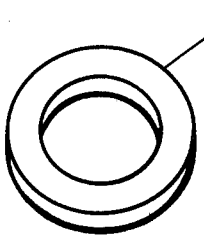
FIG. 2 illustrates a perspective view of an elastic ring washer suitable for use in the present invention.
Figure 3:
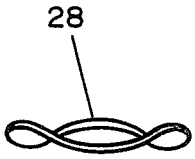
FIG. 3 illustrates a perspective view of a metal wave spring washer suitable for use in the present invention.

In place of a metal wave spring washer there may be utilized a belleville washer, curved spring washer, conical spring washer, and the like. Further, a washer or disc of elastomeric material of suitable compressive strength and compatible with the explosive material, such as natural or synthetic rubber, particularly polyurethane rubber, can be employed as the spring or resilient washer. Such washers may contain a metal spring molded therein for additional compressive strength. Suitable elastomers include Adiprene® urethane rubber, which is manufactured by E. I. du Pont de Nemours & Co. A solid disc or ring 36 of elastomeric material, as illustrated in FIG. 2, can be advantageously employed in the present invention, since, unlike a wave spring washer, coil spring, etc, it is not penetrated and hence immobilized by possible plastic flow or "creep" of the cast explosive.

The following tests demonstrate the effectiveness of the present invention for eliminating base separation in 155 mm M107 projectiles loaded with 15 lbs. of cast explosive consisting of Composition B (60% RDX, 40% TNT and 1% added wax), utilizing a strong threaded aluminum fuze well liner and a steel wave spring washer. The fuze well cavity was drilled using a bit with no bevel and having a diameter of 1.895 inches. A standard steel wave spring washer was placed on the flat base of the cavity and compressed to its maximum stress level by controlling the depth of the fuze well. The wave spring washer employed had the following characteristics:

O.D. 1.819 in.
I.D. 1.404 in.
Stock Thickness 0.020 in.
Free Height 0.125 in.
Max. Compression 0.062 in.
Load at Max. Compression 30 lbs.
Load at 0.031 in. Compression 15 lbs.

Four projectiles, fitted with spring washers and liners in this manner, were conditioned at −40° F. for 12 hours and at −20° F. for 12 hours. Base separation was measured after each cycle. The results are set forth in the following table and show that the wave spring washer effectively compensated for cast shrinkage and prevented base separation essentially completely.

| | Sample 1 (Inches) | Sample 2 (Inches) | Sample 3 (Inches) | Sample 4 (Inches) |
|---|---|---|---|---|
| Threaded Liner Outside Length | 3.894 | 3.894 | 3.896 | 3.895 |
| Inside Depth | 3.854 | 3.832 | 3.853 | 3.853 |
| Thickness of Base Liner | 0.040 | 0.062 | 0.043 | 0.042 |
| Radiography Results - Initial | No Cracks | No Cracks | No Cracks | No Cracks |
| The projectiles were notched by removing a quadrant of the base of the projectile to expose the cast explosive. | | | | |
| Base Separation after Notch | 0.008 | 0.003 | 0.006 | 0.015 |
| Fuze Well Cavity Depth | 5.007 | 4.993 | 4.996 | 4.991 |
| Liners (no washer) Torqued in Place | | | | |
| Depth of Liner (no washer) | 4.962 | 4.931 | 4.953 | 4.949 |
| Gap Between Liner and Cast | 0.005 | 0.000 | 0.000 | 0.000 |
| *Liner and Washer Torqued in Place at Up to 20 Inch Pounds | | | | |
| Depth of Liner with Washer | 4.899 | 4.869 | 4.893 | 4.887 |
| Original Height of Washer | 0.125 | 0.125 | 0.125 | 0.125 |
| *Debris already present in liner threads necessitated using 20 inch pounds on one liner. The others needed less than 5 inch pounds of torque. | | | | |
| Distance washer is Compressed | 0.056 | 0.062 | 0.064 | 0.062 |
| Remaining Height of Washer | 0.069 | 0.063 | 0.061 | 0.063 |
| Load Deflected to This Height Range is 30 Pounds | | | | |
| Base Separation | 0.000 | 0.000 | 0.000 | 0.000 |
| Cooled at −40° F. for 12 Hours | | | | |
| Base Separation Horizontally in Cooler | 0.000 | 0.000 | 0.000 | 0.000 |
| Base Separation Standing on Nose | 0.000 | 0.000 | 0.008 | 0.004 |

-continued

| | | | | |
|---|---|---|---|---|
| *Base Separation With Projectile Standing on Nose After Push With Dowel | **0.020 | 0.015 | 0.008 | 0.004 |
| Base Separation Horizontally 10 Min. After Removal from Cooler Cooled to −20° F. for 12 Hours | 0.009 | 0.004 | 0.000 | 0.000 |
| Base Separation Horizontally in Cooler | 0.000 | 0.000 | 0.000 | 0.000 |
| Base Separation With Projectile Standing on Nose | 0.000 | 0.000 | 0.000 | 0.000 |
| Base Separation on Nose After Push With Dowel | 0.020 | 0.006 | 0.000 | 0.000 |
| Base Separation Horizontally 10 Min. After Removal from Cooler Cooled at −40° F. for 12 Hours With No Washer and No Liner | 0.008 | 0.000 | 0.000 | 0.000 |
| Base Separation With Projectile Standing on Nose After Push With Dowel | 0.039 | 0.040 | 0.041 | 0.052 |
| Radiography Results | No Cracks | No Cracks | No Cracks | No Cracks |

Making several measurements of base separation on each projectile leads to the possibility of creating artificial base separation by removing explosive.
Base separation measurements were made with feeler gages ½" wide.
*Pushing was done on the base of the cast exposed at the notch. The cast would move toward the nose and when the dowel was removed the cast would move upward toward the base. The FIGS. given are those recorded after the dowel was removed and the cast returned toward the base.
**This cast stuck. Further pushing with the dowel caused the cast to return to 0.009 inch from the base.
The wave spring washer performed better than what had been theoretically expected. The following is theoretical shrinkage of the cast:
Theoretical Shrinkage: 0.0005 inch per 1° F.
Ambient Temperature: 72° F.
At −40° F., B.S. - [72 − (.40] × 0.0005 Inch = 0.056

| | Sample 1 (Inches) | Sample 2 (Inches) | Sample 3 (Inches) | Sample 4 (Inches) |
|---|---|---|---|---|
| Theoretical Base Separation | 0.056 | 0.056 | 0.056 | 0.056 |
| Distance washer is Compressed | 0.056 | 0.062 | 0.064 | 0.062 |
| *Theoretical: 15 lb. Spring Force at Compression of | 0.031 | 0.031 | 0.031 | 0.031 |
| Calculated Base Separation | 0.025 | 0.031 | 0.033 | 0.031 |
| Measured Base Separation (−40° F.) | 0.020 | 0.015 | 0.008 | 0.004 |
| Measured Base Separation at −40° F. with No Liner and No washer | 0.039 | 0.040 | 0.041 | 0.052 |

With all four projectiles, the actual base separation was less than the theoretical base separation.
*Thus the compensator should expand only to 0.031 inches from original height.

The foregoing disclosure and drawings are merely illustrative of the principles of this invention and are not to be interpreted in a limiting sense. I wish to be understood that I do not desire to be limited to the exact details of construction shown and described because obvious modifications will occur to a person skilled in the art.

I claim:

1. A projectile comprising in combination:

a metal casing having a closed base end and a forward end having a threaded central opening;

a cast explosive charge filling said casing, said charge having a longitudinal cylindrical cavity at its forward end to receive a fuzewell liner for containing a fuze for detonating said charge, a fuzewell liner positioned in said cavity and threadedly secured to said casing at said threaded opening; and a resilient means compressed between the bottom of said cavity and the bottom of said liner, wherein said compressed resilient means presses against said liner and said cast explosive with a force sufficient to prevent or greatly minimize separation of said cast explosive from the base end of said casing in response to thermal contraction or expansion of said cast.

2. The projectile of claim 1, wherein said liner and cavity bottoms are essentially flat and horizontal.

3. The projectile of claim 1, wherein the resilient means comprises a metal wave spring washer.

4. The projectile of claim 3, wherein a flat metal washer is positioned between said spring washer and said cavity bottom.

5. The projectile of claim 3 or 4 wherein the washer has a coating of organic material compatible with said explosive charge.

6. The projectile of claim 1, wherein the resilient means includes a solid washer comprising an organic elastomeric material.

7. The projectile of claim 1, 2, or 3, wherein the resilient means has an annular configuration and is positioned in an annular channel at the bottom of said explosive cast cavity, whereby said cast provides a stop for said liner and prevents over-compression of said resilient means.

8. The projectile of claim 6, wherein the elastomeric material is a polyurethane elastomer.

9. In a method for loading an artillery projectile having a closed base end and a forward end including a threaded central opening, with explosive, which includes filling the projectile shell with a cast explosive charge, drilling a longitudinal cavity in said charge through the threaded open end of said projectile shell, inserting a fuzewell liner into said cavity and threadedly securing said liner to said projectile shell, wherein the improvement comprises inserting a resilient means between the bottom of said liner and the bottom of said cavity and tightening said liner to compress said resilient means and thereby cause said resilient means to press against said liner and said cast with a force sufficient to prevent or greatly minimize separation of said cast from the base of said projectile shell in response to thermal contraction or expansion of said explosive cast in said projectile shell.

10. The method of claim 9, wherein the resilient means comprises a metal wave spring washer.

11. The method of claim 9, wherein the cast explosive comprises trinitrotoluene.

12. The method of claim 10, wherein the resilient means includes a washer comprising an organic elastomeric material.

13. The method of claim 12, wherein the elastomeric material includes a polyurethane elastomer.

* * * * *